US007249417B2

(12) United States Patent
Chu

(10) Patent No.: US 7,249,417 B2
(45) Date of Patent: Jul. 31, 2007

(54) POCKETKNIFE WITH A SAFETY LOCK

(76) Inventor: Chi-Tung Chu, No. 9, Alley, 7, Lane 118, Syh-Wei Rd., Wu-Ku Hsiang, Taipei Hsien (TW)

( * ) Notice: Subject to any disclaimer, the term of this patent is extended or adjusted under 35 U.S.C. 154(b) by 217 days.

(21) Appl. No.: 11/158,046

(22) Filed: Jun. 22, 2005

(65) Prior Publication Data

US 2006/0288584 A1 Dec. 28, 2006

(51) Int. Cl.
*B26B 3/00* (2006.01)

(52) U.S. Cl. ..... 30/155; 30/160; 30/161

(58) Field of Classification Search ..... 30/155, 30/160, 161

See application file for complete search history.

(56) References Cited

U.S. PATENT DOCUMENTS 1,397,018 A * 11/1921 Priestman ..... 30/155
2,199,899 A * 5/1940 Watson ..... 81/437
4,083,110 A * 4/1978 Goldin et al. ..... 30/155
4,536,959 A * 8/1985 Ross ..... 30/161
5,615,484 A * 4/1997 Pittman ..... 30/161
5,953,821 A * 9/1999 Mearns ..... 30/161
6,305,085 B1 * 10/2001 Stallegger et al. ..... 30/161
7,152,327 B2 * 12/2006 Rudisill et al. ..... 30/155
2006/0168817 A1 * 8/2006 Kao ..... 30/153

* cited by examiner

*Primary Examiner*—M. Rachuba
(74) *Attorney, Agent, or Firm*—Birch, Stewart, Kolasch & Birch, LLP

(57) ABSTRACT

A pocketknife has a handle, a blade, a safety lock and a spring. The handle has a blade seat, a cover, a cavity, a slide slot, a passage and a pivot slot. The blade is mounted pivotally in the cavity and has a proximal end, two opposite edge and two wheels. The wheels are attached respectively to the edges of the blade, and one wheel has an engaging element. The safety lock is mounted slidably in the handle and has a slide and a latch. The slide is mounted slidably in the slide slot. The latch engages detachably the engaging element in the locking wheel on the blade. The spring is mounted in the slide slot in the handle and presses the safety lock so that the latch on the slide engages the engaging element to securely hold the blade when the blade is open or closed.

6 Claims, 7 Drawing Sheets

POCKETKNIFE WITH A SAFETY LOCK

BACKGROUND OF THE INVENTION

1. Field of the Invention

The present invention relates to a pocketknife, and more particularly to a pocketknife with a safety lock that securely holds a blade in a closed and an open position.

2. Description of Related Art

Foldable knives are generally used to cut or whittle articles and are compact so they can be safely carried in a person's pocket.

A conventional pocketknife has a handle, a blade and a spring. The handle has an inside edge, an outside edge, a front end, a rear end and a longitudinal slot. The longitudinal slot is formed in the inside edge. The blade is attached pivotally to the front end of the handle, folds into the longitudinal slot in the handle for storage or extends from the front end for use and has a proximal end. The proximal end is pivotally attached to the front end of the handle. The spring is a leaf type spring, is mounted in the outside edge of the handle and abuts the blade to keep the blade closed when the blade is folded into the handle and to keep the blade open when the blade extends from the front of the handle. However, wearing of the proximal end of the blade and weakening of the spring may allow the blade to open when subjected to an inadvertent external impact, and the exposed blade may injure the person carrying the knife.

To overcome the shortcomings, the present invention provides a pocketknife with a safety lock to mitigate or obviate the aforementioned problems.

SUMMARY OF THE INVENTION

The main objective of the invention is to provide a pocketknife with a safety lock that securely holds a blade in a handle or in an extended position.

A pocketknife in accordance with the present invention comprises a handle, a blade, a safety lock and a spring.

The handle has a blade seat, a cover, a cavity, a slide slot, a passage and a pivot slot.

The blade is mounted pivotally in the cavity in the handle and has a proximal end, two opposite edges and two wheels. The wheels are attached respectively to the edges of the blade, and one wheel has an engaging element.

The safety lock is mounted slidably in the handle and has a slide and a latch. The slide is mounted pivotally in the slide slot. The latch engages detachably the engaging element in the wheel on the blade.

The spring is mounted in the slide slot in the handle and presses the safety lock so that the engaging elements engage each other to securely hold the blade when the blade is open or closed.

Other objectives, advantages and novel features of the invention will become more apparent from the following detailed description when taken in conjunction with the accompanying drawings.

DETAILED DESCRIPTION OF PREFERRED EMBODIMENT

Figure 1:
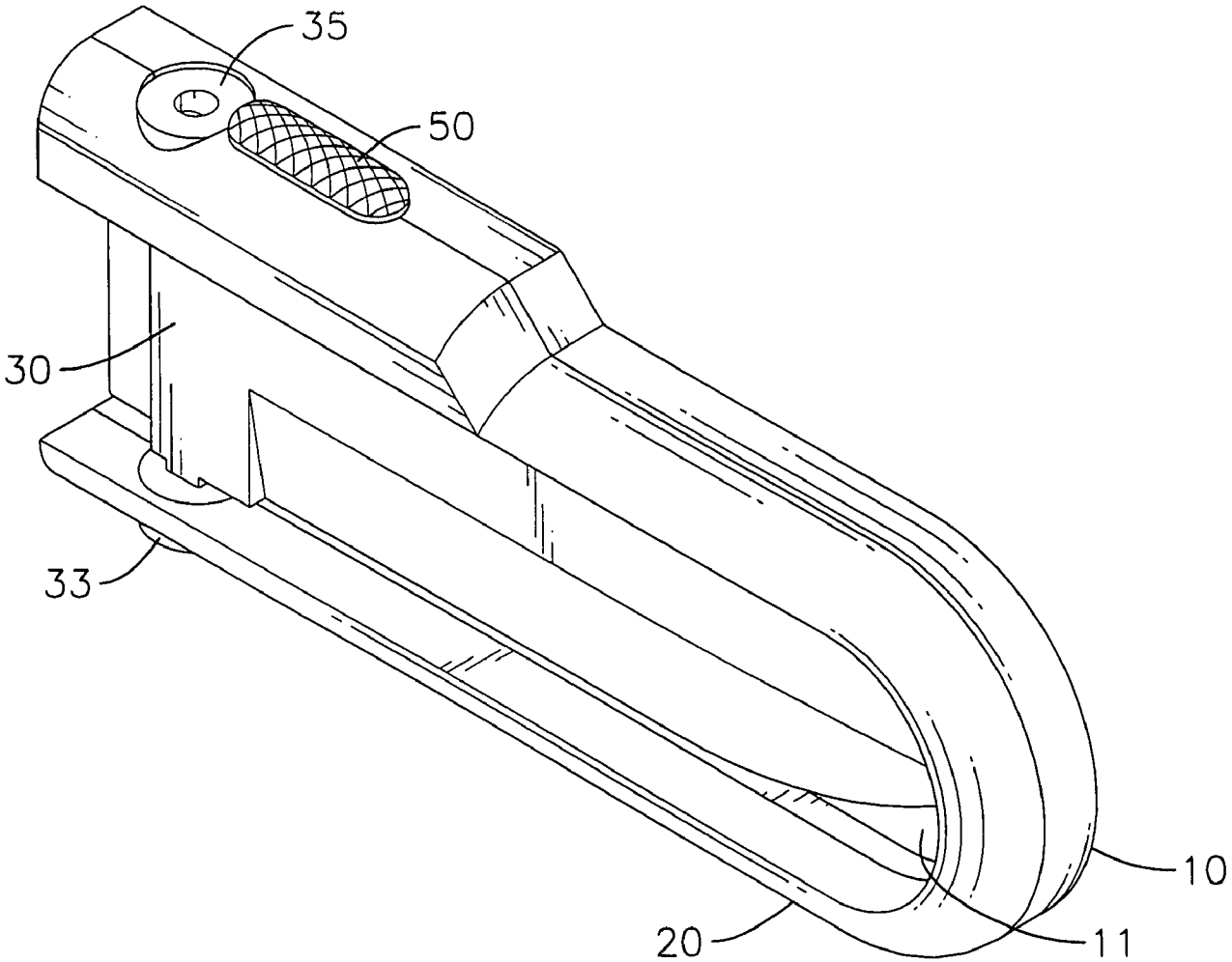
FIG. 1 is a perspective view of a pocketknife with a safety lock in accordance with the present invention.
Figure 2:
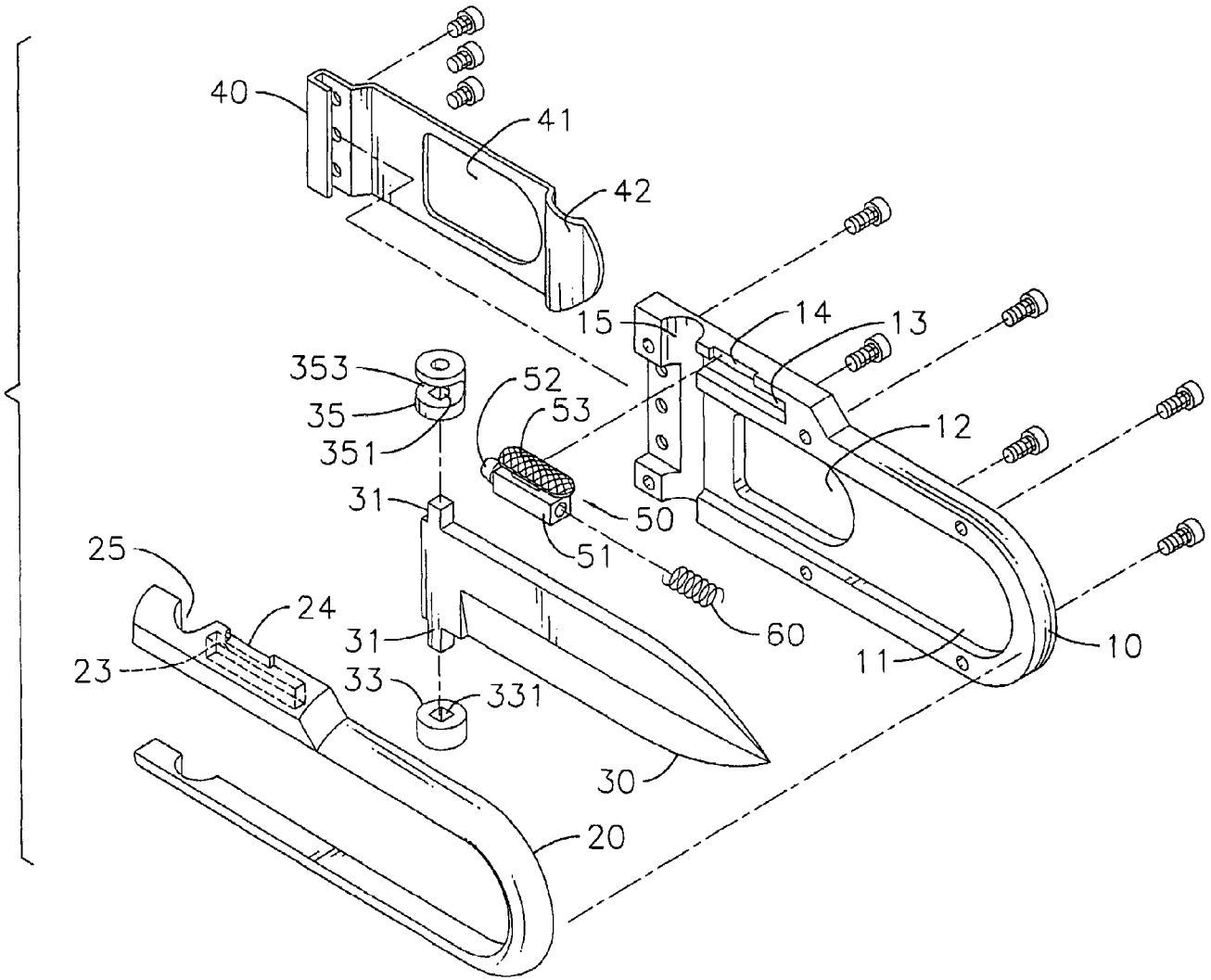
FIG. 2 is an exploded perspective view of the pocketknife in FIG. 1.

With reference to FIGS. 1 and 2, a pocketknife in accordance with the present invention comprises a handle, a blade (30), a safety lock (50), a spring (60) and an optional clasp (40).

The handle has a left side, a right side, a blade seat (10) and a cover (20).

The blade seat (10) has a front end, an inner side, an outer side, an upper edge, a lower edge, a cavity (11), an opening (12), a slide slot half (13), a passage half (14) and a semicylindrical pivot slot (15). The cavity (11) is defined in the inner side of the blade seat (10) between the edges and has an open end at the front end of the blade seat (10). The opening (12) is defined through the blade seat (10) and communicates with the cavity (11). The slide slot half (13) is defined longitudinally in the inner side of the blade seat (10) close to the front end. The passage half (14) is defined in one edge and communicates with the slide slot half (13). The semicylindrical pivot slot (15) is defined transversely in the inner side of the blade seat (10) close to the front end of the blade seat (10) and communicates with the slide slot half (13).

The cover (20) is U-shaped, is mounted on the inner side of the blade seat (10) around the cavity (11) and has an upper leg, a lower leg, a slide slot half (23), a passage half (24) and two semicylindrical pivot slots (25). The upper and lower legs correspond respectively to the upper and lower edges of the blade seat (10) and have inner and outer sides. The inner sides abut the inner side of the blade seat (10). The slide slot half (23) is defined longitudinally in the inner side of the upper leg and combines with the slide slot half (13) in the blade seat (10) to form a slide slot. The passage half (24) is defined in the inner side of the upper leg, communicates with the slide slot half (24) in the cover (20) and combines with the passage half (14) in the blade seat (10) to form a passage. The semicylindrical pivot slots (25) are defined in the inner sides respectively of the upper and lower legs, combine with the semicylindrical pivot slot (15) in the blade seat (10) to form an upper pivot hole and a lower pivot hole, and the semicylindrical pivot slot (25) in the upper leg communicates with the slide slot half (23).

Figure 3:
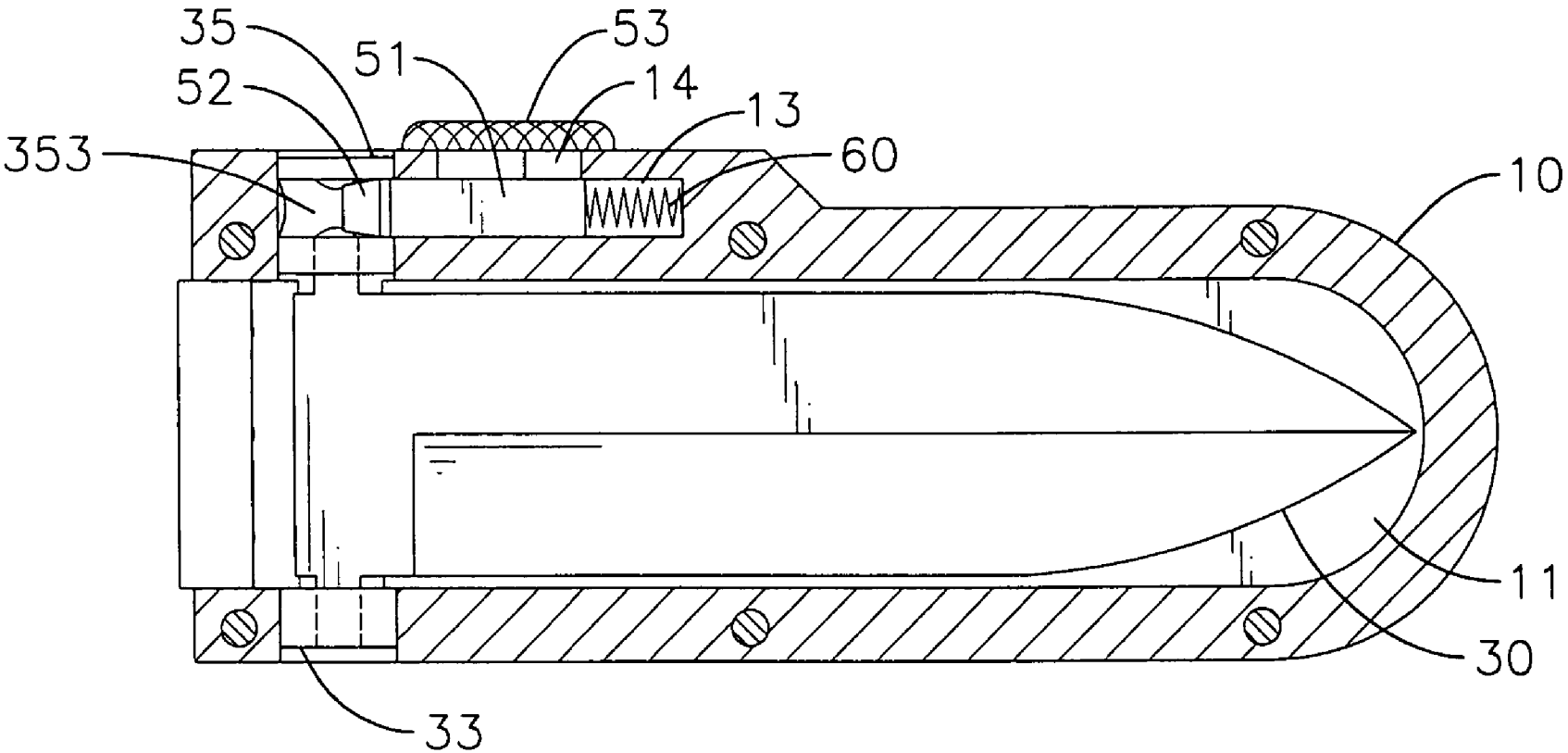
FIG. 3 is a side view in partial section of the pocketknife in FIG. 1.
Figure 7:
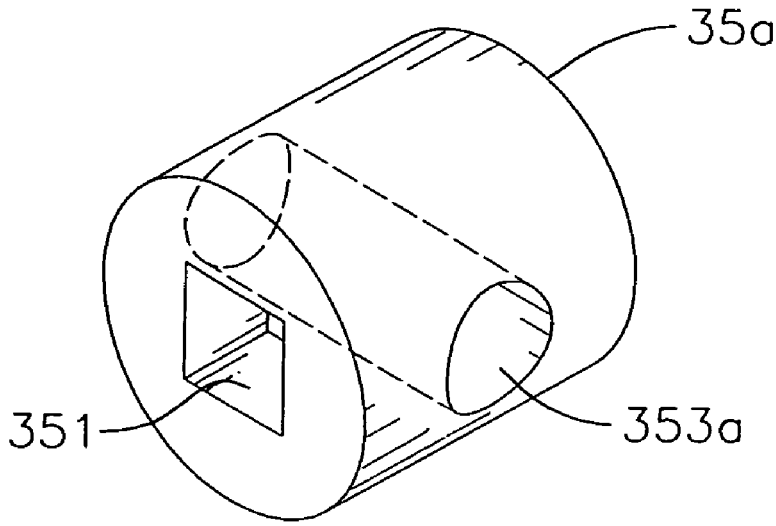
FIG. 7 is a perspective view of a second embodiment of an engaging element of a locking wheel used in a pocketknife in accordance with the present invention.
Figure 8:
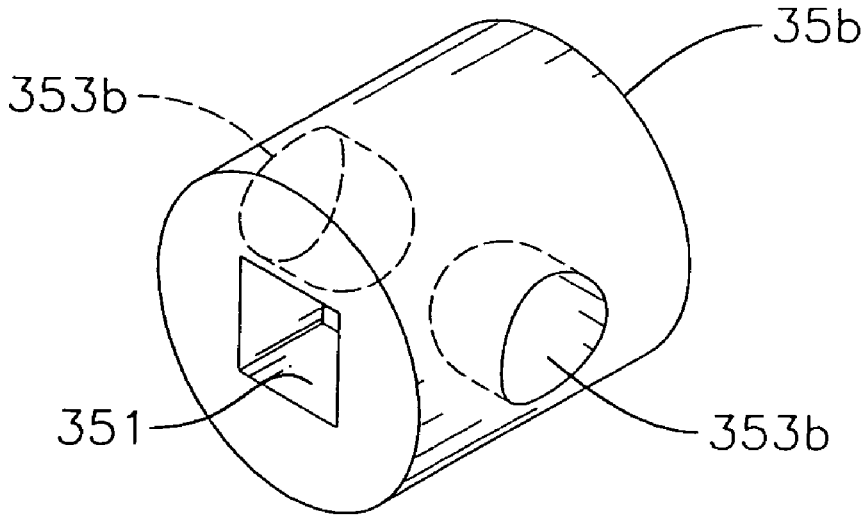
FIG. 8 is a perspective view of a third embodiment of an engaging element of a locking wheel used in a pocketknife in accordance with the present invention.

With further reference to FIGS. 3, 7 and 8, the blade (30) is mounted pivotally in the cavity (11) in the handle and has a proximal end, two edges, a point, two optional pins (31) and two wheels (33, 35, 35*a*, 35*b*)

The pins (31) are formed respectively on the edges of the blade (30) near the proximal end, and each pin (31) has a non-circular cross-section.

The wheels (33, 35, 35*a*, 35*b*) are attached respectively to the edges of the blade (30), may be mounted respectively on the pins (31) or may be formed integrally on the edges and are rotatably mounted respectively in the pivot holes in the handle. The wheel mounted in the upper pivot hole is a locking wheel (35, 35*a*, 35*b*). Each wheel (33, 35, 35*a*, 35*b*) has an inner end, an outer end and an optional mounting hole (331, 351). The mounting holes (331, 351) are defined respectively in the inner ends of the wheels (33, 35, 35*a*, 35*b*), have a non-circular cross-section and are mounted respectively on the pins (31) and allow the pins (31) to respectively extend through the mounting holes (331, 351). The locking wheel (35, 35*a*, 35*b*) has an engaging element defined transversely in the locking wheel (35, 35*a*, 35*b*).

A first embodiment of the engaging element is an open slot (353) defined transversely in the locking wheel (35). A second embodiment of the engaging element is a through hole (353*a*) defined radially through the locking wheel (35*a*). A third embodiment of the engaging element are two blind holes (353*b*) defined radially and coaxially in the locking wheel (35*b*).

Figure 4:
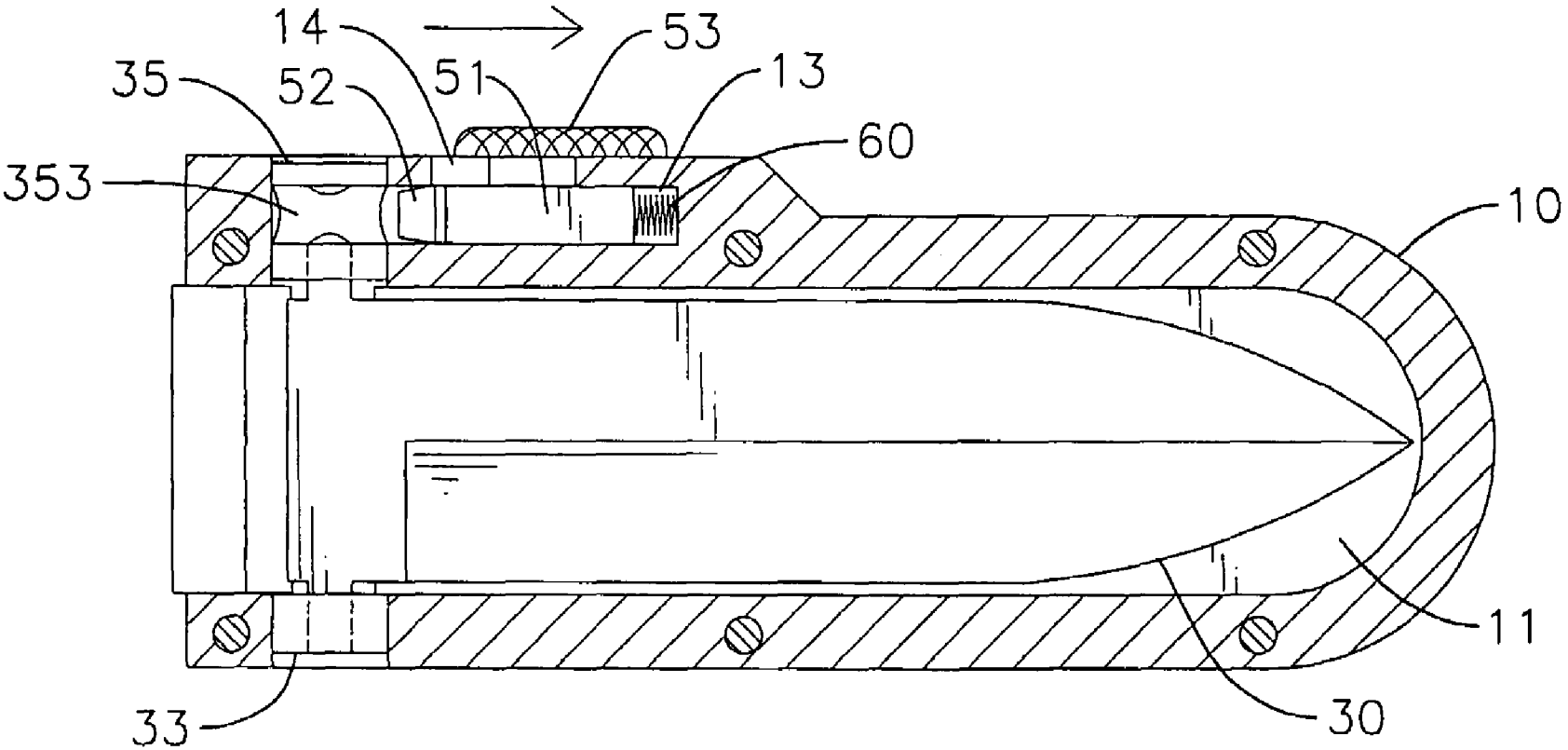
FIG. 4 is an operational side view in partial section of the pocketknife in FIG. 3.
Figure 5:
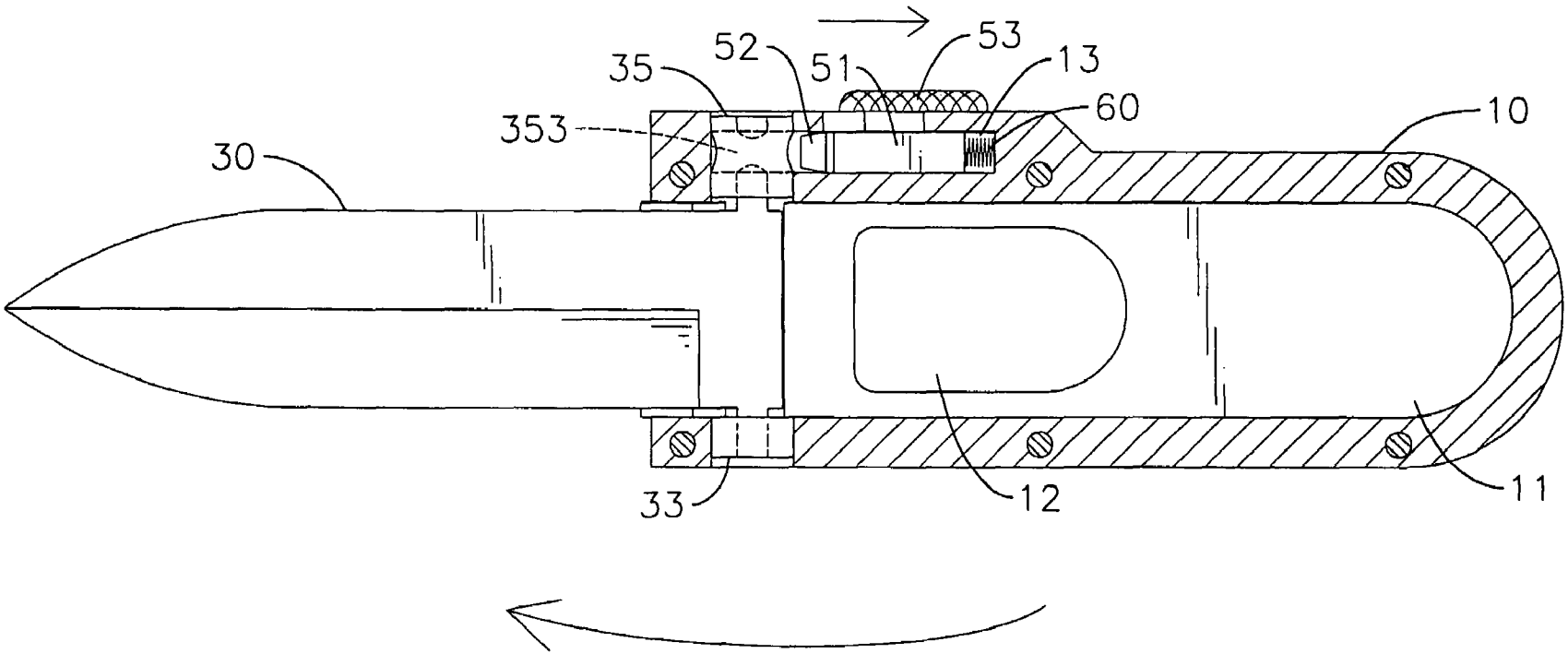
FIG. 5 is an operational side view in partial section of the pocketknife in FIG. 4 with the blade extended.
Figure 6:
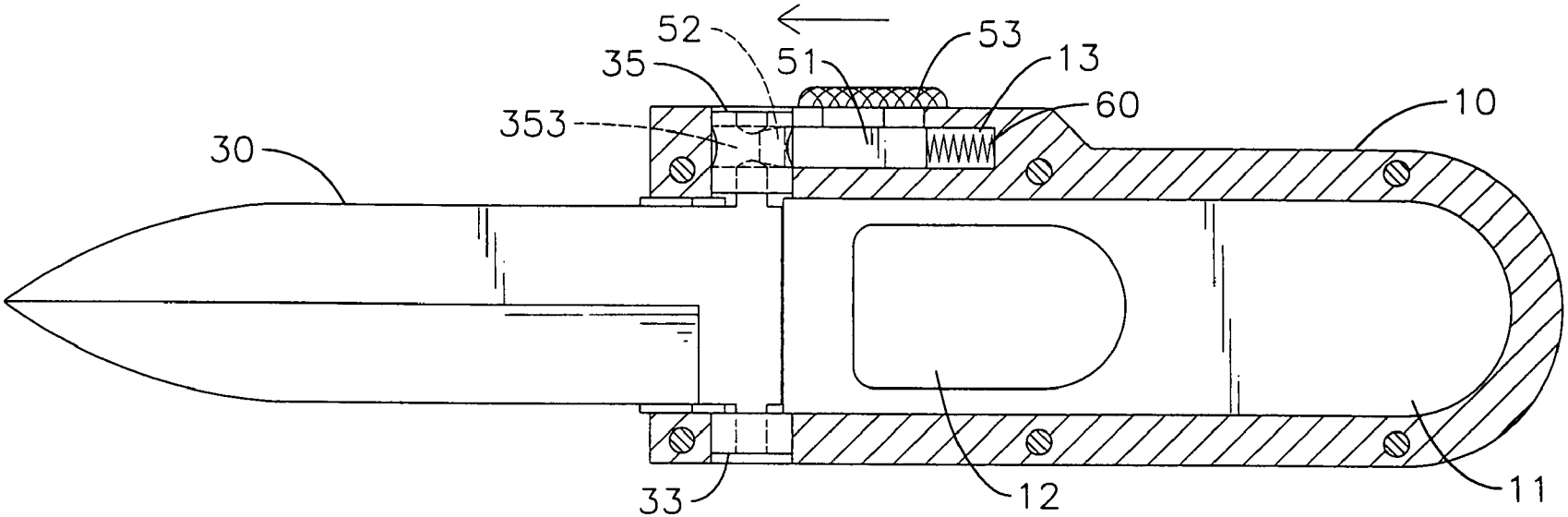
FIG. 6 is an operational side view in partial section of the pocketknife in FIG. 5 with the open blade locked.

With further reference to FIGS. 4, 5 and 6, the safety lock (50) is mounted slidably in the handle, securely holds the blade (30) open or closed and selectively releases the blade (30) so the blade (30) can be pivoted. The safety lock (50) has a slide (51), a latch and a knob (53).

The slide (51) is mounted slidably in the slide slot in the handle and has a proximal end, a distal end and a top.

The latch is formed on the distal end of the slide (51), faces the upper pivot hole in the handle and detachably engages the engaging element in the locking wheel (35, 35*a*, 35*b*) on the blade (30). The latch may be a protrusion (52) corresponding to the open slot (353), the through hole (353*a*) and the blind holes (353*b*) in the locking wheel (35, 35*a*, 35*b*).

The knob (53) is formed on the top of the slide (51) and extends through the passage out of the handle so a person can pull the knob (53) manually with a thumb to slide the safety lock (50) and detach the latch from the locking wheel (35, 35*a*, 35*b*).

The spring (60) is mounted in the slide slot in the handle, presses against the proximal end of the slide (51) of the safety lock (50). The spring (60) supplies a resilient force to push the slide (51) so the latch on the slide (51) engages the engaging element in the locking wheel (35, 35*a*, 35*b*) when the blade (30) is open or closed.

The clasp (40) is resilient, is mounted on the handle and has a proximal end, a distal end, an opening (41) and a contact (42). The proximal end is connected to the front end of the blade seat (10). The opening is defined through the clasp (40) and is aligned with the opening in the blade seat (10). The contact (42) is formed on the clasp (40) and abuts the outer side of the blade seat (10).

The safety lock (50) in the handle securely holds the blade (30) when the blade is open or closed so that an external force cannot cause the blade (30) to inadvertently open or close. Furthermore, operating the safety lock (50) is easy. Therefore, the pocketknife is safe and is handled easily.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A pocketknife comprising:

a handle having a left side;

a right side;

a blade seat having a front end, an inner side, an outer side, an upper edge, a lower edge, a cavity defined in the inner side of the blade seat between the edges and having an open end at the front end of the blade seat, an opening defined through the blade seat and communicating with the cavity, a slide slot half defined longitudinally in the inner side of the blade seat close to the front end, a passage half defined in one edge and communicating with the slide slot half, and a pivot slot being defined transversely in the inner side of the blade seat close to the front end and communicating with the slide slot half; and a cover mounted on the inner side of the blade seat around the cavity and having an upper leg corresponding to the upper edge of the blade seat and having an inner side abutting the inner side of the blade seat;

a lower leg corresponding to the lower edge of the blade seat and having an inner side abutting the inner side of the blade seat;

a slide slot half defined longitudinally in the inner side of the upper leg and combining with the slide slot half in the blade seat to form a slide slot;

a passage half defined in the inner side of the upper leg, communicating with the slide slot half in the cover and combining with the passage half in the blade seat to form a passage, and two pivot slots defined in the inner sides respectively of the upper and lower legs, combining with the pivot slot in the blade seat to form an upper pivot hole and a lower pivot hole, and the pivot slot in the upper leg communicating with the slide slot half;

a blade mounted pivotally in the cavity in the handle and having a proximal end, two edges, a point, and two wheels attached respectively to the edges, rotatably mounted respectively in the pivot holes in the handle, each wheel having an inner end and an outer end, and the wheel mounted in the upper pivot hole being a locking wheel having an engaging element defined in the locking wheel;

a safety lock mounted slidably in the handle, securely holding the blade open or closed and having a slide mounted slidably in the slide slot in the handle and having a proximal end and a distal end;

a latch formed on the distal end of the slide, facing the upper pivot hole in the handle and detachably engaging the engaging element in the locking wheel on the blade, and a knob formed on the slide and extending through the passage out of the handle; and a spring mounted in the slide slot in the handle and pressing against the proximal end of the slide of the safety lock.

2. The pocketknife as claimed in claim 1, wherein:

the engaging element in the wheel on the blade is an open slot defined transversely in the locking wheel; and the latch on the slide is a protrusion corresponding to the open slot.

3. The pocketknife as claimed in claim 1, wherein:

the engaging element in the locking wheel on the blade is a through hole defined radially through the locking wheel; and the latch on the slide is a protrusion corresponding to the through hole.

4. The pocketknife as claimed in claim 1, wherein:

the engaging element in the locking wheel on the blade is two blind holes defined radially and coaxially in the locking wheel; and the latch on the slide is a protrusion corresponding to the two blind holes.

5. The pocketknife as claimed in claim 1, wherein:

the blade further has two pins formed respectively on the upper and lower edges of the blade, and each pin has a non-circular cross-section; and the wheels on the blade are mounted respectively on the pins, and each wheel further has a mounting hole defined in the inner end of the wheel, having a non-circular cross-section and through which one of the pins extends.

6. The pocketknife as claimed in claim 1 further comprising a clasp being resilient, mounted on the handle and having a proximal end connected to the front end of the blade seat, a distal end, an opening defined through the clasp and aligning with the opening in the blade seat, and a contact formed on the clasp and abutting the right side of the handle.

* * * * *